United States Patent [19]

Sullivan

[11] 4,141,820

[45] Feb. 27, 1979

[54] PROCESS FOR UPGRADING ARSENIC-CONTAINING OILS

[75] Inventor: Richard F. Sullivan, San Rafael, Calif.

[73] Assignee: Chevron Research Company, San Francisco, Calif.

[21] Appl. No.: 825,872

[22] Filed: Aug. 18, 1977

[51] Int. Cl.[2] ..... C10G 17/00

[52] U.S. Cl. ..... 208/251 H; 208/254 H

[58] Field of Search ..... 208/253, 251 H, 254 H, 208/48 R

[56] References Cited

U.S. PATENT DOCUMENTS

| | | | |
|---|---|---|---|
| 2,897,131 | 7/1959 | Berger | 208/253 |
| 2,954,339 | 9/1960 | Beavon | 208/251 H |
| 3,069,350 | 12/1962 | Ramella | 208/253 |
| 3,558,475 | 1/1971 | Jaffe | 208/254 H |
| 3,764,519 | 10/1973 | Meyer | 208/254 H |
| 3,900,390 | 8/1975 | Adams et al. | 208/251 H |
| 4,008,149 | 2/1977 | Itoh et al. | 208/251 H |
| 4,016,067 | 4/1977 | Fischer et al. | 208/251 H |
| 4,052,296 | 10/1977 | Montagna | 208/254 H |

*Primary Examiner*—Delbert E. Gantz
*Assistant Examiner*—Joseph A. Boska
*Attorney, Agent, or Firm*—D. A. Newell; R. H. Davies; R. H. Evans

[57] ABSTRACT

A method is provided for avoiding feed-transfer-line plugging by a deposit comprising arsenic in hydroprocessing an oil containing an arsenic contaminant. In the method, a mixture of hydrogen gas and the oil is formed in situ in a bed of porous particulate contact material.

6 Claims, 1 Drawing Figure

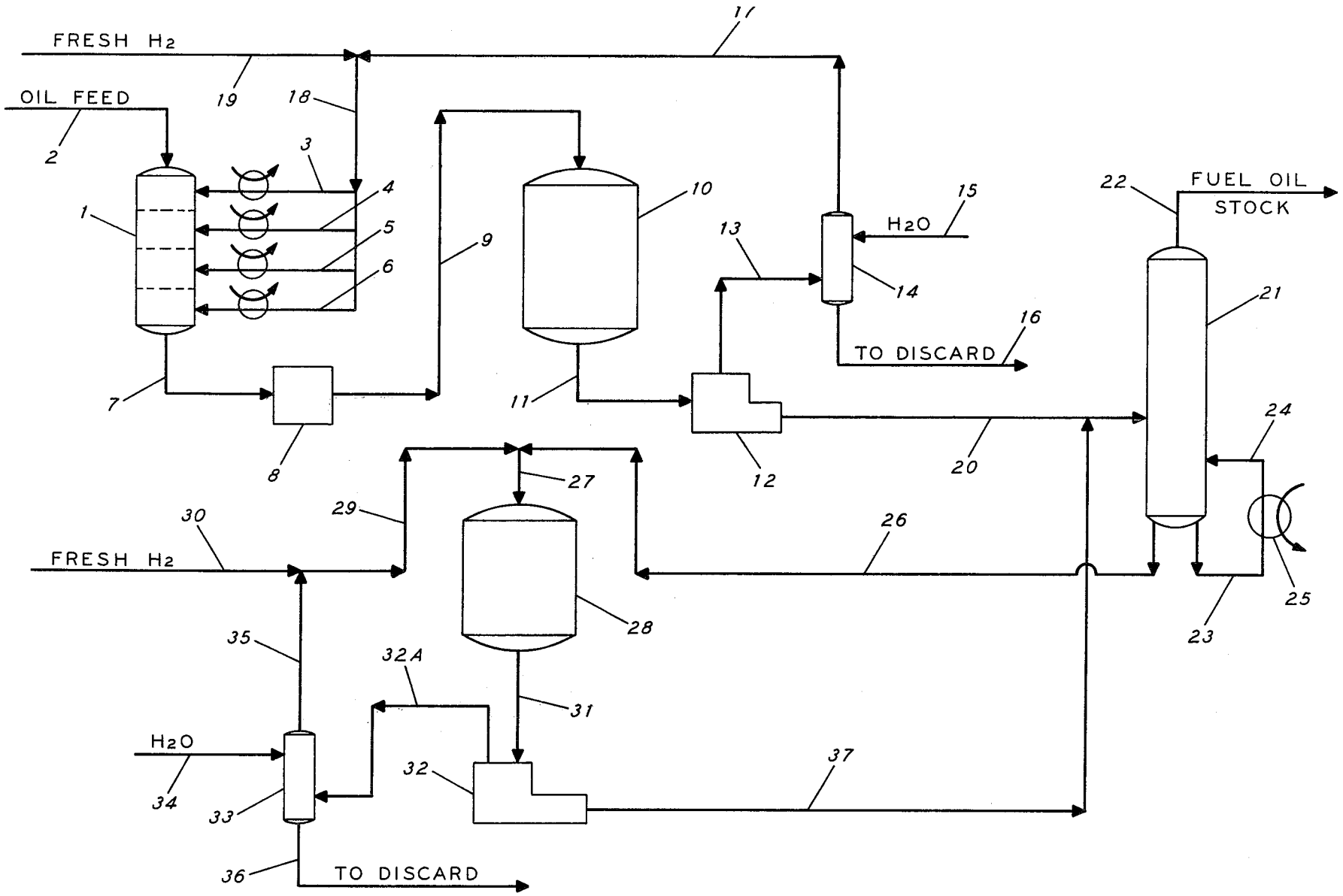
FUEL OIL STOCK
TO DISCARD
$H_2O$
TO DISCARD
FRESH $H_2$
OIL FEED
FRESH $H_2$
$H_2O$
TO DISCARD

PROCESS FOR UPGRADING ARSENIC-CONTAINING OILS

GOVERNMENT RIGHTS

The Government of the United States of America has rights in this invention pursuant to Contract No. EF-76-C-01-2315 awarded by the U.S. Energy Research and Development Administration.

BACKGROUND OF THE INVENTION

This invention relates to an improved method for removing a contaminant comprising arsenic from a hydrocarbonaceous oil, for example a synthetic crude oil such as shale oil.

It is known that contaminants comprising arsenic poison catalysts ordinarily employed in upgrading hydrocarbonaceous oils, particularly hydrocarbon hydrodenitrification catalysts. Customarily, a mixture of hydrogen gas and the oil is contacted with a suitable material in a guard bed, the object being to deposit the arsenic in some form upon the material (see, for example, U.S. Pat. No. 3,876,533, J. A. Meyers; and 4,003,829, E. D. Burger et al). However, I have discovered that a solid comprising arsenic prematurely deposits out of the oil prior to reaching the guard-bed material, with resulting fouling and blocking of feed-transfer lines.

An object of this invention is to prevent fouling and blocking of feed-transfer lines in a process for removing a contaminant comprising arsenic from a hydrocarbonaceous fluid.

SUMMARY OF THE INVENTION

An improved process is provided for reducing the arsenic content of an arsenic-containing hydrocarbonaceous oil feedstock by contacting under arsenic-removing conditions a mixture of said oil and hydrogen gas with a porous contact material comprising at least one solid refractory oxide selected from the group consisting of the oxides of the elements of Groups II, III and IV of The Periodic Table, said contacting being at a temperature in the range of from about 200° C. to 500° C., said mixture being formed in situ in the presence of said contact material, whereby the resulting oil contains less arsenic than said feedstock.

In a further aspect of the present invention, at least a portion of the decontaminated oil resulting from the aforementioned contacting is upgraded by removing bound nitrogen therefrom by contacting said decontaminated oil with a hydrocarbon hydrodenitrification catalyst, preferably a silica-alumina composite containing titania, nickel and tungsten, under hydrocarbon hydrodentrification conditions.

EMBODIMENT

In a preferred embodiment of the process herein, a shale oil containing impurities comprising arsenic (organoarsenic compounds resulting from shale retorting) is upgraded by (1) reducing the arsenic content of the oil; and (2) hydro-denitrifying at least a portion of the oil resulting from step (1). The upgraded oil is useful of itself as a heating oil, or it is suitable, in whole or part, as desired, as base stock for further upgrading for producing a transportation fuel, for example jet fuel, diesel and gasoline.

Referring to the figure, a whole shale oil (see Table I) containing impurities comprising arsenic (organoarsenic compounds resulting from shale retorting) and about a 2.2 weight percent of nitrogen-containing impurities (calculated as N) is introduced at a temperature of about 150° C. into guard-bed reactor 1 via line 2. Concurrent with the introduction of the oil, hot hydrogen gas is separately introduced into reactor 1 via lines 3, 4, 5 and 6. The temperature of the gas in lines 3, 4, 5 and 6 is an increasing gradient starting from the upper line and is adjusted to provide an oil-gas mixture temperature of about 400° C. for the effluent stream which is withdrawn from reactor 1 via line 7. The feed rates for the hydrogen and oil are adjusted to provide (1) a hydrogen-to-oil rate of about 1421 SCM per cubic meter of feed; (2) a liquid hourly space velocity for the feed of about 1.1 v/v/hr.; (3) a hydrogen partial pressure of about 135 atmospheres; and (4) a total system pressure of about 160 atmospheres.

In reactor 1, the oil-gas mixture is contacted with a porous contact material. The material provides a large surface area for contacting the oil-gas mixture and a repository for the precipitated arsenic values resulting therefrom. For this embodiment, the contact material employed is a more-or-less spent hydrocarbon hydrodenitrification catalyst, for example such as described below for use in reactor 10. Residual activity in the spent catalyst advantageously causes some useful reduction in nitrogen content of the oil.

The oil withdrawn via line 7 contains little or, for practical purposes, none of the arsenic-containing impurities. Also, depending upon the amount of residual hydrocarbon denitrification activity, it has a reduced content of bound (carbon-to-nitrogen) nitrogen. Via line 7, unit 8 and line 9, the arsenic-reduced oil is delivered to the reactor 10 for further upgrading by nitrogen removal. Unit 8 is an indirect heat exchanger, heating furnace, or the like, suitable for adjusting and controlling the temperature of the oil-gas feed mixture which is introduced into downflow reactor 10.

In reactor 10, the nitrogen content of the arsenic-reduced oil is reduced to about 600 ppmw by contacting this oil with a fixed-bed hydrocarbon hydrodenitrification catalyst composite (see U.S. Pat. No. 3,425,934; Jacobson and Tolberg) having a surface area of at least about 290 $m^2$ per gram, a pore volume of at least about 0.4 cc per gram and the following composition:

| Component | Weight |
|---|---|
| NiO | 10 |
| $WO_3$ | 25 |
| $SiO_2$ | 27 |
| $Al_2O_3$ | 30 |
| $TiO_2$ | 8 |

The contacting of the feed mixture with the catalyst in reactor 10 is effected under hydrocarbon hydrodenitrifying conditions adjusted to result in a whole effluent oil having a nitrogen content in the 600- to 700-ppmw range, preferably about 650 ppmw. To this end and using a fresh catalyst of the above-described composition, satisfactory process conditions include:

| | |
|---|---|
| Temperature, ° C. | 395 |
| $H_2$ Partial Pressure, Atm. | 129 |
| $H_2$ Rate, $SCM/M^3$ | 888 |
| System Pressure, Atm. | 151 |
| LHSV, V/V/Hr. | 0.6 |

The hydrocarbon conversions which take place in reactor 10, on balance, are exothermic. Any suitable known method may be employed for maintaining temperature control, for example by hydrogen quench means (lines for introducing hydrogen quench gas not shown in the FIGURE).

As the catalyst ages and loses activity, the reaction temperature in reactor 10 is increased until the cut-off temperature, for example about 450° C., is reached. At this time it is regenerated or replaced as desired.

Via line 11 a mixture of partially hydrodenitrified oil, unconsumed hydrogen gas, ammonia and other light gases normally present in a petroleun hydrocarbon hydrodenitrification product stream is withdrawn from reactor 10 and delivered to liquid-gas separator 12. The gas separated in separator 12 is mainly hydrogen and ammonia. It is withdrawn therefrom via line 13 and delivered to ammonia scrubber 14 in which wash water which is introduced via line 15 adsorbs ammonia from the gas and the resulting aqueous-ammonia solution is withdrawn from scrubber 14 via line 16 for discharge from the process. The residual gas in scrubber 14, which is mainly hydrogen, is recycled to the process via lines 17 and 18, together with makeup hydrogen, which is added to the system via line 19 as required.

The separated liquid in liquid-gas separator 12 is withdrawn therefrom via line 20 and delivered to fractionator 21 for separation by fractional distillation into an overhead fraction having at one atmosphere pressure a boiling poing below about 343° C. and a bottoms fraction boiling above said temperature. The former fraction is withdrawn from fractionator 21 via line 22 for recovery, for example as a light fuel oil stock, or further processing, as desired. Lines 23, 24 and unit 25 prescribe a conventional reboiler system.

The bottoms fraction separated in fractionator 21 is withdrawn therefrom via line 26 for delivery to downflow reactor 28. This reactor also contains a hydrodenitrification catalyst as described for use in reactor 10. The feed to reactor 28 has been found to contain the major portion of the residual nitrogen-containing impurities present in the oil fraction of the effluent product stream from reactor 10. The fractionation in column 21 has been found to be advantageous for reasons including: (1) excessive cracking of the light oil components in the shale oil feedstock and resulting treated oil is avoided; and (2) by adjusting the conditions in reactor 28 to result in about a 60 weight percent per-pass conversion of the bottoms oil to product boiling below about 343° C., an effluent oil product, having a nitrogen impurity content of about 2 ppmw, is obtained.

The process conditions required for use in reactor 28 vary depending upon the cracking and hydrodenitrification activities of the catalyst. As the catalyst ages in use, it loses activity and, again, the temperature in reactor 28 is increased as required to maintain the desired conversion. Suitable temperatures are, in general, in the range of from about 360° to 440° C. While control of the conversion by varying the reaction temperature is preferred for process control, other prime process variables may also be utilized alone and/or in combination with temperature control for this purpose, for example by decreasing the space velocity (increasing contact time) as the catalyst ages in use. Typically, with a fresh catalyst, the temperature in reactor 28 is desirably maintained at about 355° C. initially and at about 370° C. after it is lined out. The other process conditions — hydrogen partial pressure and rate, etc. — are desirably as prescribed for use in reactor 10.

Via line 27, bottom-fraction oil from column 21 plus recycle hydrogen from line 29 plus makeup hydrogen as required from line 30 is introduced into downflow reactor 28. Reactor 28 is also fitted with hydrogen gas quench lines (not shown) for use as required in controlling the reaction temperature. The resulting mixture of hydrodenitrified and partially cracked oil, unconsumed hydrogen, ammonia and minor light gases (hydrogen sulfide, methane, etc.) produced in reactor 28 is withdrawn therefrom via line 31 and delivered to liquid-gas separator 32, wherein the mixture is separated into an oil fraction and a gas fraction. The gas fraction, which is mainly hydrogen and ammonia, is withdrawn from separator 32 via line 38 and delivered to ammonia scrubber 33 wherein the ammonia content thereof is adsorbed into wash water introduced into scrubber 33 via line 34. Scrubbed hydrogen is withdrawn from scrubber 33 via line 35 for recycle to the process and aqueous ammonia is withdrawn via line 36 for discharge from the process.

Via line 37 the hydrodenitrified and partially cracked oil separated in separator 32 is withdrawn therefrom. This oil is suitable in whole or part for use as a fuel oil stock. Preferably it is delivered in extinction recycle to column 21 together with the oil in line 20 for separation into the aforementioned heavy and light fractions. It also may be used, in whole or part, as feedstock for a separate hydrocarbon cracking or hydrocracking stage.

By "hydrocarbon hydrodenitrifying conditions" as used herein is meant the process conditions usually employed in the catalytic removal of nitrogen-containing impurities from a hydrocarbon feedstock in the presence of hydrogen gas, including: (1) a temperature in the range of from about 260° C. to 500° C., preferably 370° C. to 425° C.; (2) a hydrogen partial pressure in the range of from about 50 to 170 atmospheres, preferably 90 to 150 atmospheres; (3) a hydrogen rate in the range of from about 355 to 1775 SCM per cubic meter of oil, preferably 888 to 1421 SCM/$M^3$; (4) a total system pressure in the range of from about 55 to 185 atmospheres, preferably 100 to 165 atmospheres; and (5) a liquid hourly space velocity (v/v/hr.) in the range of from about 0.1 to 10, preferably 0.5-2.

By "hydrocarbon hydrodenitrification catalysts" as used herein is meant, in general, catalysts normally employed in removing nitrogen-containing impurities from a hydrocarbonaceous oil by contacting the oil and hydrogen gas with the catalyst under hydrocarbon hydrodenitrifying conditions, said catalysts, in general, comprising an inorganic refractory oxide carrier component and at least one hydrogenation component, the latter usually being at least one of the metals, oxides and sulfides of elements of Groups VI and VIII of the Periodic Table of the Elements. However, ordinary hydrocarbon hydrodenitrification catalysts have been found to vary materially in their relative effectiveness for removing nitrogen from shale oil (see Example 2). It has been found that exceptional performance in terms of catalyst life and effective nitrogen removal from shale oil is exhibited where the oxide carrier component comprises porous titania-modified silica-alumina and the hydrogenation component comprises nickel and tungsten oxides and/or sulfides, a preferred hydrocarbon hydrodenitrification catalyst type for use herein.

Contact Materials

Porous oil-insoluble solids, in general, are suitable for use herein for removing arsenic-containing impurities from an oil. Pores in the solid provide a situs for a solid interface for hydrogen gas-oil contacting and for the deposition of the arsenic and for retaining same, thus guarding a downstream catalyst(s) from arsenic poisoning. Preferably the contact material has a surface area of at least 10 $m^2/g$, more preferably at least 50 $m^2/g$, and most preferably at least 150 $m^2/g$. The sizing of the pores providing said surface area may vary widely so long as the diameters thereof are at least sufficiently large as to permit effective ingress of the arsenic-containing impurities therein, for example having a diameter of at least about 40 Angstroms. Preferably at least about 10% of the pore volume providing said surface area is provided by pores (determined by the mercury porosimetry method) having average diameters in the range of from about 50 to 1000 Angstroms.

The sizing of the contact material suitable for use herein may vary widely, depending in the main upon the usual considerations where contacting of an oil and a solid is to be by fluid bed, fixed bed, or slurry contacting means, that is, in the range of from about 10 microns to about 0.6 cm.

The composition of the porous contact material may vary widely and, in general, those materials comprising at least one solid refractory oxide of the elements of Groups II, III and IV of the Periodic Chart of the Elements are satisfactory. As a practical matter, and because of severe cost considerations in the recovery and processing of oils containing arsenic-containing impurities, such as shale oil, preferred contact materials for use herein include kieselguhr, diatomaceous earths, spent or substantially spend (no longer economically feasible for continued use) hydrocarbon conversion catalysts. Preferred contact materials for use herein include ordinary spent or substantially spent hydrocarbon hydrodenitrification catalysts.

ARSENIC-REMOVING CONDITIONS

By "arsenic-removing conditions" as used herein is meant conditions including

| | Broad Range | Preferred Range |
|---|---|---|
| Temperature, ° C | 200–500 | 250–450 |
| Hydrogen Partial Pressure, Atm. | 1–100 | 5–50 |
| LHSV, v/v/hr | 0.1–20 | 1–5 |

where the arsenic-removing conditions proximate or correspond essentially to those of a secondary hydrocarbon hydroconversion step, for example a hydrodenitrification step, to be carried out in a fixed-bed reactor, the guard-bed contact material may be included as a first bed (i.e., the upstream bed) of a multibed reactor. Preferably, for reasons of process flexibility, the contacting of the feed and hydrogen is carried out in a separate contacting zone or reactor.

Feedstock

Hydrocarbonaceous oils containing impurities comprising arsenic are, in general, upgraded by the present method and are contemplated for use herein. Representative oils include crude shale oils, petroleum crude oils, and mixtures and fractions thereof containing a significant (at least 20 ppmw) amount, calculated as arsenic, of arsenic-containing impurities. As the content of arsenic-containing impurity increases, so does the relative advantage for the present method increase over known processing methods. Shale oils are preferred feedstocks for use herein.

EXAMPLES

The following examples further illustrate the present invention. No limitation of the invention, other than as expressed in the appended claims, is intended to be taken from these examples.

EXAMPLE 1

In this example, a typical whole Paraho shale oil was upgraded by reducing the nitrogen content of the oil. The inspections for this oil are listed below in Table I.

TABLE I

| PROPERTIES OF DEWATERED PARAHO SHALE OIL | |
|---|---|
| Gravity, ° API | 20.2 |
| Sulfur, Wt. % | 0.66 |
| Total Nitrogen, Wt. % | 2.18 |
| Oxygen, Wt. % | 1.16 |
| Arsenic, ppmw | 28 |
| Pour Point, ASTM, ° C. | 32 |
| Carbon, Wt. % | 83.13 |
| Hydrogen, Wt. % | 11.43 |
| Hydrogen/Carbon Atomic Ratio | 1.64 |
| Chloride, ppmw | <0.2 |
| Sodium, ppmw | 5 |
| Ash, Wt. % (ASTM D-486) | 0.03 |
| Filter Residue Ash (0.8-micron filter) | |
| Total Solids, ppmw | 234 |
| Ash, ppmw | 168 |
| Filter Residue Ash (0.45-micron filter) | |
| Total Solids, ppmw | 252 |
| Ash, ppmw | 194 |
| Hot Heptane Asphaltenes (incl. any fines), wt. % | 0.17 |
| ASTM D-1160 Distillation, ° C. (at 10 mm Hg pressure) | |
| St/5 | 197/236 |
| 10/30 | 264/348 |
| 50 | 413 |
| 70/90 | 465/535 |
| EP | 550 (94%) |
| % Overhead (Excl. Trap) | 94 |
| % in Trap | 1 |
| % in Flask | 5 |

The upgrading was carried out by introducing a preheated (400° C.) mixture of hydrogen gas and shale oil into contact with a hydrocarbon hydrodenitrification catalyst under hydrodenitrifying conditions (see Table II below). The catalyst used was a composite of nickel and tungsten supported on a titania-modified silica-alumina support sized for fixed-bed use and was characterized as follows:

| Component | Wt. % |
|---|---|
| NiO | 10 |
| $WO_3$ | 25 |
| $SiO_2$ | 27 |
| $TiO_2$ | 8 |
| $Al_2O_3$ | Balance |

having a surface area of about 300 $m^2/g$ and a pore volume of about 0.4 g/cc. After about 700 hours on-stream time, the catalyst had "lined out" and the whole liquid product nitrogen content was about 0.27 weight percent.

TABLE II

| Hydrocarbon Hydrodenitrification Conditions | Broad Range | Ex. No. 1 |
|---|---|---|
| Temperature, ° C. | 315–480 | 395 |
| $H_2$ Partial Pressure, Atm. | 50–500 | 129 |
| $H_2$ Recycle Rate, SCM/$M^3$ | 355–1775 | 888 |
| Total Pressure, Atm. | 55–550 | 151 |
| LHSV | 0.1–10 | 0.6 |

The nitrogen content of the whole liquid product resulting from increasing the temperature to 408° C. was found to be 700 ppmw. At this temperature, the liquid hourly space velocity was raised and the corresponding nitrogen contents of the whole products were as follows:

| LHSV | Nitrogen Content, ppmw |
|---|---|
| 0.6 | 700 |
| 0.3 | 30 |
| 0.2 | 2 |

After about 1800 hours of onstream time, an apparent rapid loss of catalyst activity and pressure drop problems were noted, and the run was terminated at about 2000 hours. Surprisingly, the catalyst bed contained no plug and was free-flowing. There was, however, a plug of powder-like black material in the preheat line via which the shale oil-hydrogen feed mixture was introduced into the catalyst-containing reaction zone. This solid was analyzed be a combination of the energy-dispersive and wavelength-dispersive X-ray fluorescence methods and found to have the elemental analysis by weight percent as follows:

| Component | Wt. % |
|---|---|
| Iron | 30 |
| Arsenic | 11.4 |
| Zinc | 3.8 |
| Calcium | 1 |
| Selenium | 0.2 |
| Carbon | 14.7 |
| Sulfur | 15.4 |

The catalyst used in the above-described run was sectioned into 14 layers, and as noted in Table III was found to have substantial contents of arsenic and iron.

TABLE III

Arsenic and Iron in Aged Catalyst from Example I After Processing 1060 Volumes Whole Shale Oil Per Volume of Catalyst

| Layer No. | Wt. of Layer, q | Cumulative (From Top), q | Iron, Wt. % | Arsenic, Wt. % |
|---|---|---|---|---|
| 1 | 4 | 4 | 3.4 | 3.3 |
| 2 | 5 | 9 | 2.5 | 2.0 |
| 3 | 11 | 20 | 1.7 | 1.3 |
| 4 | 11 | 31 | 1.3 | 0.89 |
| 5 | 10 | 41 | | |
| 6 | 11 | 52 | 0.90 | 0.50 |
| 7 | 10 | 62 | | |
| 8 | 11 | 73 | 0.75 | 0.28 |
| 9 | 10 | 83 | | |
| 10 | 13 | 96 | 0.20 | 0.062 |
| 11 | 12 | 108 | | |
| 12 | 9 | 117 | | |
| 13 | 12 | 129 | | |
| 14 | 5 | 134 | 0.043 | 0.0083 |

*In addition, a total of 5.6 g of fines (smaller than 24 mesh) was distributed throughout the bed.

This example, in particular, demonstrated that: (1) heated mixtures of arsenic-containing oils and hydrogen gas deposit arsenic-containing solids in and plug transfer lines used to introduce such mixtures into a reaction zone; and (2) in order to protect a hydrocarbon hydrodenitrification catalyst from arsenic poisoning when used in processing such oils, the mixture of oil and hydrogen should not be preheated and transported in a transfer line. Rather, in view of the foreoing, and most desirably, the hot mixture should be formed in situ in a mixing zone containing a porous inorganic refractory oxide having an appreciable surface area, thereby providing a surface for depositing from the oil of impurities containing arsenic.

EXAMPLE 2

Several conventional hydrocarbon hydrodenitrification catalysts were tested to determine their relative usefulness for removing nitrogen-containing impurities from shale oil. In the test, Paraho shale oil was the feedstock, and the process conditions included the following:

| | |
|---|---|
| Temperature, ° C. | 396 |
| Total System Pressure, Atm. | 126 |
| Hydrogen Gas Rate, SCM/M$^3$ | 888 |
| LHSV, v/v/hr. | 0.6 |
| Duration of Test, Hours | 100 |

The catalysts tested has the following characteristics:

| Catalyst Designation | A | B | C |
|---|---|---|---|
| Surface Area, m$^2$/g | 350 | 290 | 290 |
| Pore Volume, cc/g | 0.4 | 0.4 | 0.4 |
| Composition, Wt. % | | | |
| Group VI-B Oxide () | 21 ($WO_3$) | 25 ($WO_3$) | 30 ($MoO_3$) |
| NiO | 7 | 10 | 10 |
| $Al_2O_3$—$SiO_2$ | 47 | 57 | 41 |
| Wt. Ratio | 1 | 1 | 2 |

After 100 hours onstream the nitrogen content of the whole oil fraction of the effluent product stream for each catalyst was as follows:

| Catalyst | Nitrogen Content, ppmw |
|---|---|
| A | 1600 |
| B | 1000 |
| C | 2200 |

These data demonstrate that in the catalytic hydrodenitrification of shale oil and even for reasonably closely related hydrocarbon hydrodenitrification catalysts, the nitrogen removal effectiveness of the catalysts very markedly. Catalyst C is a superior catalyst for hydrofining shale oil.

Representative hydrocarbon hydrodenitrification catalysts suitable for use herein include those described in:

| | |
|---|---|
| U.S. Pat. No. 3,004,913 | (S. Tucker) |
| U.S. Pat. No. 3,014,860 | (C. T. Douwes et al) |
| U.S. Pat. No. 3,145,160 | (R. Jacobson) |
| U.S. Pat. No. 3,205,165 | (L. Helfman) |
| U.S. Pat. No. 3,227,646 | (R. Jacobson) |
| U.S. Pat. No. 3,265,615 | (W.C. Buss et al) |
| U.S. Pat. No. 3,345,286 | (S. M. Kovach et al) |
| U.S. Pat. No. 3,422,022 | (S. M. Kovack et al) |
| U.S. Pat. No. 3,425,934 | (R. Jacobson & R. Tolberg) |
| U.S. Pat. No. 3,481,867 | (R. N. Dellert) and |
| U.S. Pat. No. 3,749,664 | (G. A. Mickelson) |

What is claimed is:

1. In a process for substantially removing arsenic and nitrogen contaminants from a feedstock of hydrocarbon oil containing said contaminants to prevent arsenic contaminant fouling of feed-transfer lines carrying said hyrocarbon oil mixed with hydrogen, the improvement which comprises: contacting under arsenic-removing conditions, including a temperature in the range of from about 200° C. to 500° C., a mixture of said hydrocarbon oil and hydrogen with a porous contact material comprising at least one solid refractory oxide selected from the group consisting of the oxides of the elements of Groups II, III, and IV of the Periodic Table, said mixture being formed in situ in the presence of said contact material, whereby the resulting oil contains substantially less arsenic than said feedstock; hydrodenitrifying said resulting oil under hydrodenitrifying conditions using a silica-alumina composite hydrocarbon hydrodenitrifying catalyst containing titania, nickel and tungsten, to provide a partially denitrified oil having a bound nitrogen content, calculated as nitrogen, in the range from about 30 to 700 parts per million parts by weight of said resulting oil; separating said partially denitrified oil into a fraction boiling above about 329° C. and a fraction boiling below about 329° C.; and hydrodenitrifying at least a portion of said fraction boiling above about 329° C. under hydrocarbon denitrifying conditions.

2. A process as in claim 1 wherein said contact material is a spent or substantially spent hydrocarbon conversion catalyst.

3. A process as in claim 2 wherein said contact material is a hydrocarbon hydrodenitrification catalyst.

4. A process as in claim 9 wherein said arsenic-removing conditions include a hydrogen partial pressure in the range of from about 5 to 50 atmospheres, and a liquid hourly space velocity in the range of from about 1 to 5.

5. A process as in claim 1 wherein said contact material has a surface area of at least 10 $m^2$ per gram of which at least about 10% of said surface area is provided by pores having average diameters in the range of from about 40 to 1000 Angstroms.

6. A process as in claim 5 wherein said oil is shale oil.

* * * * *